US006669619B2

(12) United States Patent
Bialek

(10) Patent No.: US 6,669,619 B2
(45) Date of Patent: Dec. 30, 2003

(54) DEVICE FOR FOLDING PRINT COPIES

(75) Inventor: Herbert Bialek, Neckargemünd (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 28 days.

(21) Appl. No.: 09/950,433

(22) Filed: Sep. 10, 2001

(65) Prior Publication Data

US 2002/0046666 A1 Apr. 25, 2002

(30) Foreign Application Priority Data

Sep. 8, 2000 (DE) ..... 100 44 578

(51) Int. Cl.[7] ..... B65H 45/16; B65H 37/06

(52) U.S. Cl. ..... 493/444; 493/429; 493/437; 493/424; 493/440; 493/426; 493/431; 493/434; 493/442; 83/626; 83/630

(58) Field of Search ..... 493/429, 437, 493/440, 444, 424, 426, 431, 434, 442; 83/626, 630, 632

(56) References Cited

U.S. PATENT DOCUMENTS 3,995,850 A * 12/1976 Hertrich et al. ..... 493/444
4,425,110 A 1/1984 Grüger et al.
4,509,939 A 4/1985 Müller
4,568,319 A * 2/1986 Samata ..... 474/148
4,890,524 A * 1/1990 Brown et al. ..... 83/615
5,085,625 A 2/1992 Kojima
5,120,291 A * 6/1992 Wada et al. ..... 493/23
5,176,615 A * 1/1993 Munsch ..... 493/427
5,267,935 A * 12/1993 Bialek et al. ..... 493/444
5,458,557 A 10/1995 Bladie et al.
6,240,794 B1 * 6/2001 Simon ..... 74/52

FOREIGN PATENT DOCUMENTS

EP 0 453 832 A1 10/1991

* cited by examiner

*Primary Examiner*—Rinaldi I. Rada
*Assistant Examiner*—Brian D. Nash
(74) *Attorney, Agent, or Firm*—Laurence A. Greenberg; Werner H. Stemer; Gregory L. Mayback

(57) ABSTRACT

A device for folding printing copies in a web-fed rotary printing machine includes a folding knife, controls for reciprocatingly moving the folding knife at least approximately in one plane, the controls including a first and a second toggle lever, which, at one of the ends thereof, respectively, are movably attached to frame-fixed parts of the printing machine and at the other ends thereof, respectively, are movably attached to the folding knife, and a rotary element simultaneously actable upon both the first and the second toggle levers for operating the controls; a folder including the folding device; and an assembly including the folder with the folding device.

11 Claims, 3 Drawing Sheets

DEVICE FOR FOLDING PRINT COPIES

BACKGROUND OF THE INVENTION

Field of the Invention

The invention relates to a device for folding printing copies.

The published German Patent Document 40 18 707 A1 discloses a driving device for folding knives, which is used in polygraphic knife folding machines. Proceeding from an effort to obtain a wide-range adjustment of the height of a folding knife driven by a crank drive, the crank drive including the drive shaft thereof is vertically adjustably disposed. The changes in position of gears of a spur gear transmission associated therewith are assured by supporting rollers, by a connecting lever and by the influence of a pre-stressable compression spring. It is thereby possible to adjust the thus oscillating folding knife over a wide range without affecting the kinematics of the drive.

The published German Patent Document 29 17 616 C2 relates to a drive unit for a folding knife for folding planar items. This drive unit includes a linearly acting drive aggregate, which is represented by a traveling-field linear motor that is formed of a reaction part and a secondary part and that is movably mounted in a frame-fixed guide. The movable part of the traveling-field linear motor is arranged so as to be displaceable during the folding cycle, the linear motor being formed so as to be controllable by the sheet to be folded, and devices for dampening and counter-braking the movable part are provided in front of the return or reversal points of the movable part.

Due to the use of the linear motor in this improved arrangement, the resulting construction is not suitable for high speeds such as can occur in web-processing rotary printing presses, such as rotary newspaper web presses or jobbing or commercial rotary printing machines. With the improved embodiment according to the aforementioned published German Patent Document 29 17 616 C2, tilting of the folding knife cannot be completely prevented with respect to an off-center folding of sheets.

The published German Patent Document 30 46 051 A1 discloses a folding device for web-fed rotary printing presses. A folding device for web-fed rotary printing presses is proposed with which a longitudinal fold extending in the longitudinal direction of printing copies is formed in the printing copy. The longitudinal fold is formed in the printing copy after a cross-fold has been formed therein. A folding knife extending parallel to the transport direction of the printing copies is provided, and is suspended from two driving cranks rotating with the same rotary speed and being moved reciprocatingly. In a lower position thereof, the printing copies to be folded longitudinally are pushed between two driven folding rollers.

The suspension of the folding knife from the driving crank is effected via an additional crank. The latter is borne coaxially with pivot pins thereof at the crank pin of the driving crank. The additional crank is driven via a gear transmission at the same rotary speed as that of the driving crank, but in a direction opposite thereto, the crank pin of the additional crank executing a substantially or at least approximately vertical lifting motion.

This construction is precise because the gear transmission that is used is associated with a considerable production outlay, particularly with respect to gear teeth accuracy, which is to be produced in an involved and costly manner. This construction is therefore associated with high production costs.

SUMMARY OF THE INVENTION

Starting from the constructions of the prior art aforedescribed herein, it is an object of the invention to provide a device for folding printing copies which, moreover, generates a linearly extending lifting movement of the folding knife and which is associated with a minimal construction outlay.

With the foregoing and other objects in view, there is provided, in accordance with the invention, a device for folding printing copies in a web-fed rotary printing machine, comprising a folding knife, controls for reciprocatingly moving the folding knife at least approximately in one plane, the controls including a first and a second toggle lever, which, at one of the ends thereof, respectively, are movably attached to frame-fixed parts of the printing machine and at the other ends thereof, respectively, are movably attached to the folding knife, and a rotary element simultaneously actable upon both the first and the second toggle levers for operating the controls.

In accordance with a special feature of the invention, the folding knife serves for producing a second longitudinal fold in a printing copy in the transport direction of the respective printing copy.

In accordance with another feature of the invention, the rotary element is constructed as a double crank.

In accordance with a further feature of the invention, the toggle levers are connected to the double crank so that the toggle levers are driven at least approximately in parallel.

In accordance with an added feature of the invention, the rotary element is actable via a push rod upon the toggle levers, respectively.

In accordance with an additional feature of the invention, the rotary element is constructed as a single crank.

In accordance with yet another feature of the invention, the single crank is directly actable upon one of the toggle levers.

In accordance with yet a further feature of the invention, the second toggle lever is coupled via a push rod with the toggle lever upon which the single crank is directly actable.

In accordance with yet an added feature of the invention, the folding device includes vertical guides wherein the folding knife is guidable.

In accordance with yet an additional feature of the invention, the folding knife is movable at least approximately vertically up and down.

In accordance with still another feature of the invention, the toggle levers, respectively, are disposed by the one end thereof at a frame-fixed cross bar.

In accordance with still a further feature of the invention, the rotary element is cooperatively connected with the toggle levers so that when the rotary element rotates, the folding knife executes a reciprocatory motion.

In accordance with still an added feature of the invention, the rotary element is arranged centrally along an imaginary center line of the folding knife, and the two toggle levers are disposed on mutually opposite sides in vicinity of outer edges of the folding knife and are actable upon the folding knife.

In accordance with another aspect of the invention, there is provided a folder including a device for folding printing copies in a web-fed rotary printing machine, comprising a folding knife, controls for reciprocatingly moving the folding knife at least approximately in one plane, the controls including a first and a second toggle lever, which, at one of the ends thereof, respectively, are movably attached to frame-fixed parts of the printing machine and at the other ends thereof, respectively, are movably attached to the folding knife, and a rotary element simultaneously actable upon both the first and the second toggle levers for operating the controls.

In accordance with a concomitant aspect of the invention, there is provided an assembly including a folder having a longitudinal folding device for forming a second longitudinal fold in printing copies in a transport direction of the printing copies, the folder being preceded by a web-processing web-fed rotary printing machine, and the second longitudinal fold being producible after a cylinder crossfold is formed, the folding device comprising a folding knife accepted at two control members and being movable vertically up and down thereby, the folding knife, in a lower position thereof, serving to push printing copies between two driven folding rollers, the two control members being two driven toggle lever pairs disposed between a frame-fixed cross bar and the folding knife, and a rotary element for simultaneously controlling the toggle lever pairs, the rotary element being rotatable over one rotation thereof per one stroke of the folding knife.

The suspension of the folding knife, which is reciprocatingly movable in one plane, from driven toggle levers on frame-fixed parts of the printing machine enables an extremely high speed with great folding precision for a simple and cost-efficient structure by foregoing the use of gearing therein. Due to the drive introduction into the toggle levers, for example, at respective centrally disposed articulating points thereof, assurance is provided that identical motions extending in a horizontal plane are executed at both toggle levers, the motions being followed by a corresponding strictly linear reciprocatory motion of the folding knife. Because gearing or toothed wheel work is not used, the production costs for the folding device proposed in accordance with the invention can be reduced significantly; the linking points or articulating points of the components at the frame-fixed parts of the printing machine, at the rotary element producing the drive, as well as at the upper side of the folding knife, can be realized by bearing bushings, which are simple to produce and which have a long service life.

In an advantageous embodiment of the folding device according to the invention, the rotary element driving the toggle levers can be constructed as a double crank. The double-crank component makes it possible to link a number of driven elements at the circumference thereof and can be advantageously realized with respect to the linking points of the transmission elements at the circumference thereof with respect to the occurring knee forces. The two driven toggle levers can be driven in parallel by a double crank, so that identical vertical stroke paths result at both toggle levers. A stroke or lifting rod, which serves as a connecting rod at the same time and which can be manufactured quite simply, can be used advantageously as a power transmission element between the rotating double crank and the toggle levers which can be extended horizontally. By this construction, the rotation of the double-crank rotary element can be transformed into a vertical motion of the articulating point of a bipartite toggle lever.

In a further advantageous embodiment of the invention, the rotary element driving the toggle levers can be constructed as a single crank. The single crank can act directly upon one of the toggle levers to be driven. The second toggle lever, which is not directly driven, can be indirectly driven via a push rod proceeding from the directly driven toggle lever.

In an advantageous embodiment of the invention, the folding knife can be guided in vertical guides at both short side surfaces, so that no play can occur with respect to the folding knife guide, which would negatively influence the folding precision.

In an advantageous embodiment of the driven toggle levers, they have upper and lower parts, respectively, extending symmetrically from a linking point that can be outwardly extended in a horizontal plane, the upper parts being arranged in a frame-fixed cross bar of the folder, and the lower parts of the toggle levers being linked at the upper side of the folding knife that is reciprocable.

The folding device according to the invention for forming the second longitudinal fold in the transport direction of the printing copies can be utilized for folders for web-processing rotary printing machines which may be jobbing or commercial wed-fed rotary printing machines presses or newspaper web-fed rotary printing machines, and the folders can be realized as format-variable combination folders or as pinless folders.

Other features which are considered as characteristic for the invention are set forth in the appended claims.

Although the invention is illustrated and described herein as embodied in a device for folding printing copies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
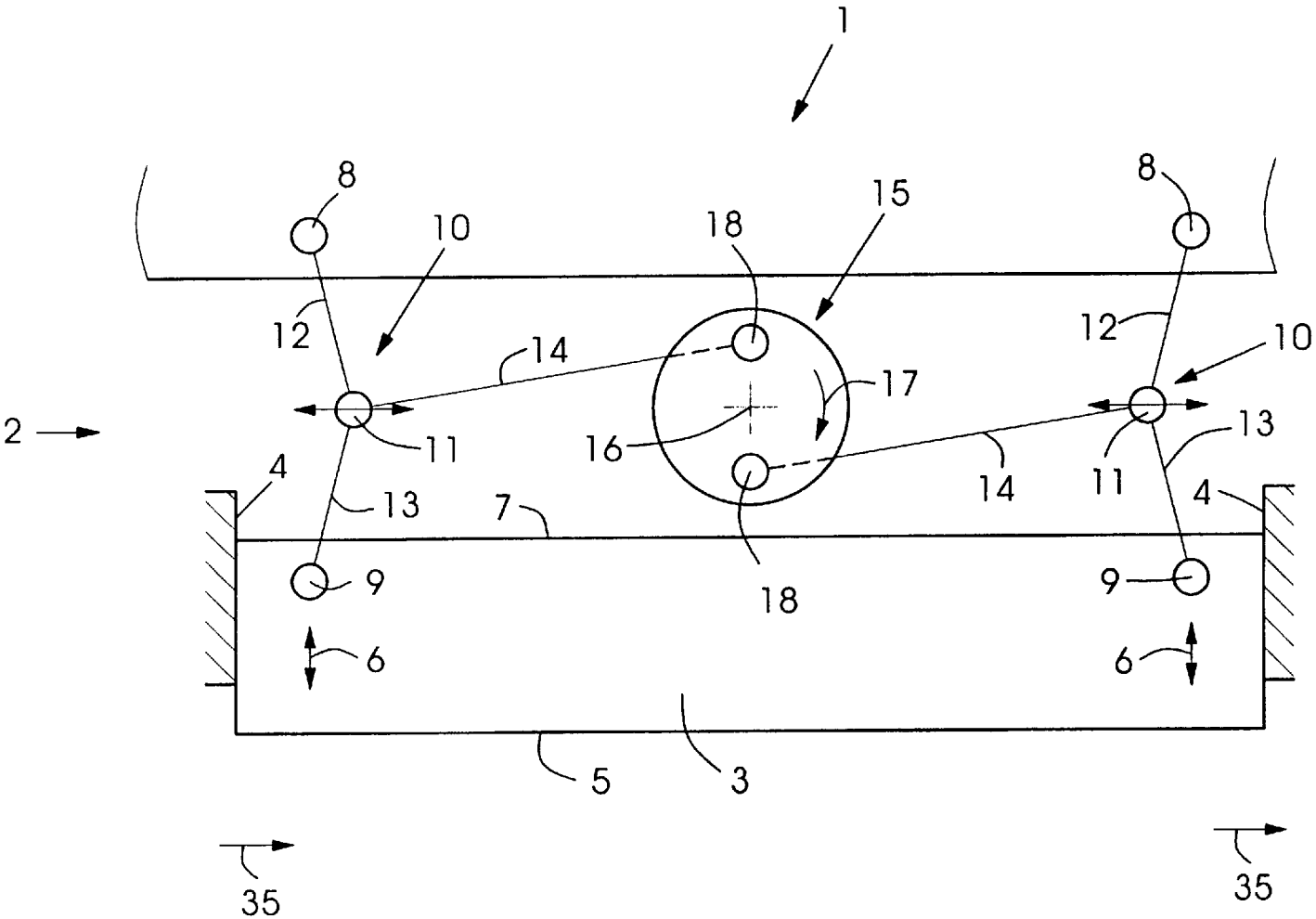
FIG. 1 is a fragmentary side elevational view of a vertically movable folding knife, which is suspended from drivable toggle lever pairs.

Referring now to the drawings and, first, particularly to FIG. 1 thereof, there is represented therein in detail, in a side elevational view, a folding knife accommodated on driven toggle lever pairs.

A so-called second longitudinal folding device 2 including a folding knife 3 that is vertically movable at least approximately upwardly and downwardly is provided in an otherwise non-illustrated folder 1. The folding knife 3 having a folding edge 5 by which it pushes printing copies, which are transported in a copy transport direction 35, into a nip between two folding rollers 37 (note FIG. 3) otherwise non-illustrated in FIG. 1. The copy to be longitudinally folded is at rest at the time that it is pushed into the nip between the otherwise non-illustrated folding roller; because the folded spine of the copy is pushed into the nip between the two driven folding copies, the folding copy to be longitudinally folded, on one hand, is transported out of the printing-copy conveying plane of the second longitudinal folding device 2, and the folded spine, on the other hand, is further formed on the printing copy, due to the folded spine being pushed between the jackets of the two driven folding rollers.

The folding knife 3, the lower folding edge 5 of which pushes the printing copies into the nip between the two driven folding rollers, is accommodated at two transmission elements 10, which are constructed as driven toggle levers in the exemplary embodiment shown in FIG. 1. The driven toggle levers 10, respectively, have an upper part 12 and a lower part 13, which are connected to one another at an articulating point 11. The upper part 12 of each toggle lever 10 is accepted in a linking point 8 at a stationary cross bar in the folder 1, whereas the lower parts 13 of the toggle levers 10 are rotatably accepted in the vicinity of the upper edge 7 of the folding knife 3 in respective linking points 9. As shown in FIG. 1, double-headed arrows in the vicinity of the articulating points 11 correspond to the horizontal plane wherein the articulating points 11 of the driven toggle levers 10 oscillate. As shown in the exemplary embodiment of FIG. 1, the articulating points 11 are connected via push rods 14 to a rotary element 15.

The rotary element 15 of FIG. 1 can be constructed, for example, as a double crank rotating around a rotational axis 16 in the direction of rotation represented by the curved arrow 17. The double-crank rotary element 15 which introduces the drive into the transmission elements 10 that are constructed as toggle levers, is driven via a drive which is not otherwise shown in detail. The push rods 14 are rotatably accommodated in mutually oppositely disposed linking points 18 of the push rods 14 at the double crank 15.

A rotation of the double crank 15 in the direction of rotation represented by the arrow 17 effects a rotation of the linking points 18 in a clockwise direction, so that the push rods 14 and, therefore, the articulating points of the driven toggle levers 10 accepting the folding knife 3, in the course of a complete rotation of the double crank 15, are synchronously moved towards one another during a half-rotation and are synchronously moved away from one another during the further half-rotation. Therefore, the rotational motion of the double crank 15 is transformed via the push rods 14 into a translational motion of the articulating points 11 in the translational plane (note the double-headed arrows). A strictly vertical motion is thereby impressed upon the folding knife 3, so that the folding knife 3, guided at the folding knife guides 4, executes a vertical upward and downward motion.

Figure 2:
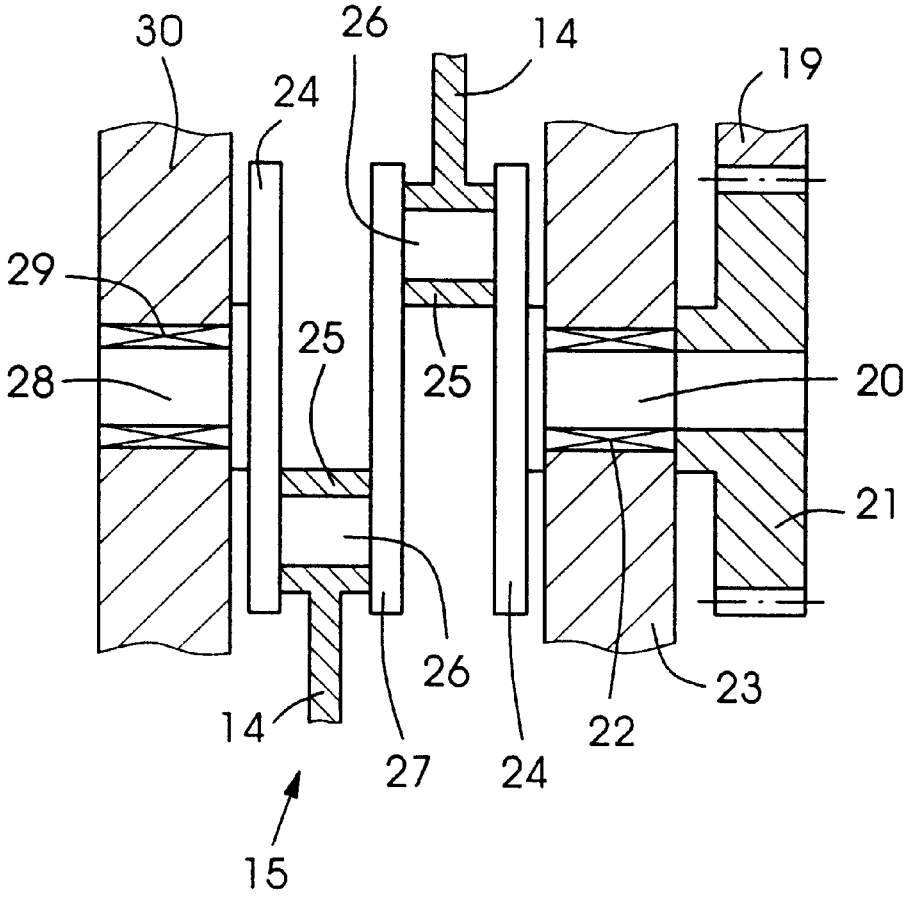
FIG. 2 is an enlarged fragmentary front elevational view, mostly in section, of FIG. 1, showing a rotational element thereof formed as a double crank.

FIG. 2 shows the double crank 15 of FIG. 1 in greater detail.

As shown in FIG. 2, the double crank 15 of FIG. 1 has two outer double crank disks 24. A double crank center disk 27 is accommodated therebetween. The two outer double crank disks 24, respectively, are provided with a journal 28 and a drive pin 20, respectively. A spur gear 21 provided with outer toothing is accepted at the driving pin 20, which is rotatably received in a bearing 22 in a wall 23. Via the outer gear teeth thereof, the spur gear 21 combs or meshes with a further drive gear 19, so that the rotational drive is introduced into the double crank 15 via the drive gear 19. An outer double crank disk 24 is accommodated at the end of the driving pin 20 located opposite the spur gear 21. A push-rod yoke 25 is rotatably borne on a pin between the middle double crank disk 27 and the outer double crank disk 24, one of the push rods 14 of FIG. 1 being rotatably borne on the double crank 15 via the push-rod yoke 25. The double crank pin 26 represents a linking point 18 as shown in FIG. 1.

The further push rod 14, which, at the double crank 15, is also rotatably borne on a double crank pin 26, is rotatable between the second double crank disk 24 and the double crank center disk 27. The further double crank disk 24 is borne by a journal pin 28 in a further wall 30. The journal pin 28 is accepted by a bearing 29.

In a simplified embodiment of the invention of the instant application, a single crank directly driving one of the toggle lever pairs 10 of FIG. 1 can also be used instead of the double crank 15 serving as a rotary element as shown in FIG. 2. In this embodiment that is not otherwise shown in detail, a connecting rod proceeding from the directly driven toggle lever 10 extends to the oppositely disposed toggle lever 10, the connecting rod being linked in the articulating point 11 thereof. Therefore, the motion of the further toggle lever 10 is coupled to the motion of the toggle lever 10 that is directly driven via a single crank, so that an up-and-down motion of the folding knife 3 extending in the vertical direction represented by the double-headed arrow 6 (note FIG. 1) results at the guide surfaces 4 thereof in the so-called second longitudinal folding device 2 of the folder 1.

Figure 3:
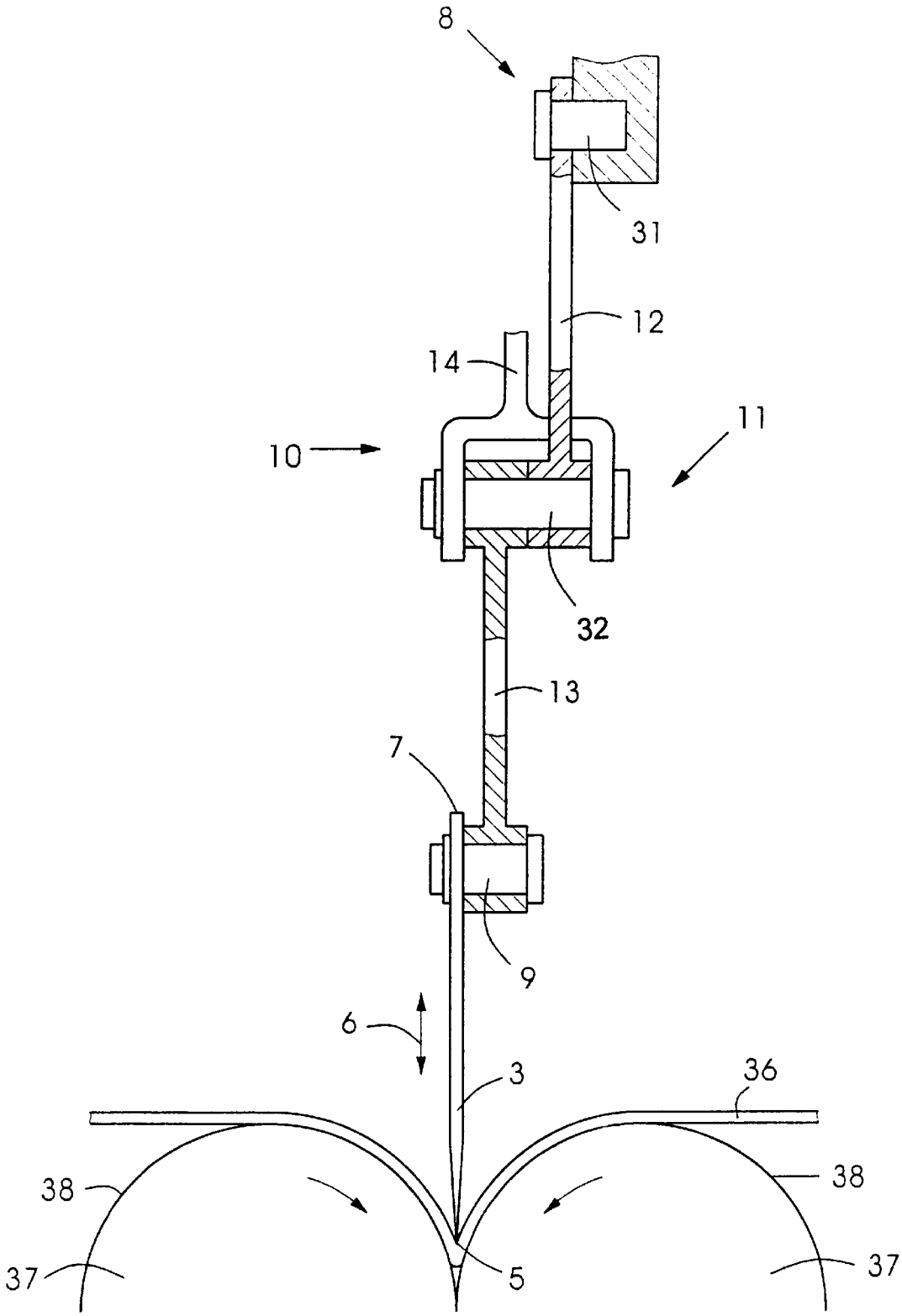
FIG. 3 is an enlarged fragmentary front elevational view of FIG. 1, showing the folding knife suspension with toggle-lever upper and lower parts, respectively, in section.

FIG. 3 is a front elevational view, partly in section, of the folding knife drive according to the invention.

In a cross bar that is stationarily accommodated in the folder 1, the upper part 12 of the driven toggle lever 10 is rotatably borne at a linking point 8. For example, the linking point 8 can be formed by a bolt 31, which is screwed into the cross bar and is provided with an outer collar. At the opposite end of the upper part 12 of the toggle lever 10, the latter is rotatably borne at an articulating hinge bolt 32 representing the articulating point 11. The lower part 13 of the toggle lever, which is rotatably borne with the oppositely disposed end thereof at the linking point 9 in the vicinity of the upper edge 7 of the folding knife 3, is also borne at the hinge bolt 32 forming the articulating point 11. The eyes of the upper part 12 and the lower part 13, respectively, of the driven toggle levers 10 accommodated at the hinge bolt 32 are enclosed by a forked shoulder of a push rod 14, which is also rotatably borne at the hinge bolt 32. A translational motion according to the double arrows of FIG. 1 is impressed onto the hinge bolt 32 of the articulating point 11 via the push rod 14 which, though not shown in FIG. 3, is accommodated in linking points 18 at a double crank 15 serving as a rotary element, for example. As a result thereof, the folding knife accommodated at the lower parts 13 of the toggle levers 10 undergoes a vertical motion in the direction of the double-headed arrow 6 (note FIG. 3, for example). The folding edge 5 of the folding knife 3, therefore, performs a strictly vertical up-and-down motion and, in the downward motion thereof, pushes a printing copy 36, which is to be longitudinally folded, into the nip between two driven folding rollers 37, so that the folded spine of the printing copy 36 can be realized therebetween.

As shown in FIG. 3, the push rod 14 linked at the hinge bolt 32 of the articulating point or joint 11 of the toggle lever 10 can also be configured as a connecting rod which extends from a toggle lever 10 that is driven via a single crank to the oppositely disposed driven toggle lever 10.

With either of the embodiments according to the invention, i.e., with a double crank 15 as shown in FIG. 2 or with a single crank directly driving a toggle lever 10, an up-and-down motion extending in vertical direction can be impressed onto the folding knife, so that a strictly linear up-and-down motion can be obtained during a rotation of the double-crank element or the single-crank element of the folding knife lower edge 5 forming the fold, wherein the double-crank element or the single-crank element translates the rotational motion into linear motion.

I claim:

1. A device for folding printing copies in a web-fed rotary printing machine, comprising a folding knife, controls for reciprocatingly moving the folding knife at least approximately in one plane, said controls including first and second toggle levers, which, at one of the ends thereof, respectively, are movably attached to frame-fixed parts of the printing machine and at the other ends thereof, respectively, are movably attached to said folding knife, and a rotary element, said rotary element being constructed as a double crank simultaneously actable upon both said first and said second toggle levers for operating said controls.

2. The folding device according to claim 1, wherein said folding knife serves for producing a second longitudinal fold in a printing copy in the transport direction of the respective printing copy.

3. The folding device according to claim 2, wherein said toggle levers are connected to said double crank so that said toggle levers are driven at least approximately in parallel.

4. The folding device according to claim 1, wherein said double crank is actable via a push rod upon said toggle levers, respectively.

5. The folding device according to claim 1, including vertical guides wherein said folding knife is guidable.

6. The folding device according to claim 1, wherein said folding knife is movable at least approximately vertically up and down.

7. The folding device according to claim 1, wherein said first and second toggle levers, respectively, are disposed by said one end thereof at a frame-fixed cross bar.

8. The folding device according to claim 1, wherein said double crank is cooperatively connected with said toggle levers so that when said double crank rotates, said folding knife executes a reciprocatory motion.

9. The folding device according to claim 1, wherein said double crank is arranged centrally along an imaginary center line of said folding knife, and wherein said two toggle levers are disposed on mutually opposite sides in vicinity of outer edges of said folding knife and are actable upon said folding knife.

10. A folder including a device for folding printing copies in a web-fed rotary printing machine, comprising a folding knife, controls for reciprocatingly moving the folding knife at least approximately in one plane, said controls including first and second toggle levers, which, at one of the ends thereof, respectively, are movably attached to frame-fixed parts of the printing machine and at the other ends thereof, respectively, are movably attached to said folding knife, and a rotary element, said rotary element being constructed as a double crank simultaneously actable upon both said first and said second toggle levers for operating said controls.

11. An assembly including a folder having a longitudinal folding device for forming a second longitudinal fold in printing copies in a transport direction of the printing copies, the folder being preceded by a web-processing web-fed rotary printing machine, and the second longitudinal fold being producible after a cylinder crossfold is formed, the longitudinal folding device comprising a folding knife accepted at two control members and being movable vertically up and down thereby, said folding knife, in a lower position thereof, serving to push printing copies between two driven folding rollers, said two control members being two driven toggle lever pairs disposed between a frame-fixed cross bar and said folding knife, and a rotary element, said rotary element being constructed as a double crank for simultaneously controlling said toggle lever pairs, said double crank being rotatable over one rotation thereof per one stroke of said folding knife.

* * * * *